US005692944A

United States Patent [19]

Pellicone

[11] Patent Number: 5,692,944

[45] Date of Patent: Dec. 2, 1997

[54] HAND HELD EXERCISE AND AMUSEMENT DEVICE

[76] Inventor: Anthony J. Pellicone, 213 Sea Spray La., Neptune, N.J. 07753

[21] Appl. No.: 713,791

[22] Filed: Sep. 13, 1996

[51] Int. Cl.[6] ..... A63B 21/22

[52] U.S. Cl. ..... 446/170; 273/109; 482/45

[58] Field of Search ..... 446/170, 421; 273/109; 482/44, 45, 46, 49, 50, 29

[56] References Cited

U.S. PATENT DOCUMENTS

| | | | |
|---|---|---|---|
| 1,623,869 | 4/1927 | Giraldi | 482/29 X |
| 1,638,003 | 8/1927 | Neumann | 482/29 X |
| 2,475,656 | 7/1949 | Bidak | 482/46 |
| 3,276,778 | 10/1966 | Luchsinger | 446/170 X |
| 3,887,185 | 6/1975 | Landreville | 273/109 |
| 4,356,915 | 11/1982 | Phillips | 446/170 X |
| 4,632,391 | 12/1986 | Orak | 446/170 X |
| 4,770,409 | 9/1988 | Wallisch | 482/45 |
| 5,058,885 | 10/1991 | Brandt | 482/50 X |
| 5,314,181 | 5/1994 | Lin | 273/109 |
| 5,399,133 | 3/1995 | Haber et al. | 482/45 X |

*Primary Examiner*—William H. Grieb
*Attorney, Agent, or Firm*—Robert M. Skolnik

[57] ABSTRACT

A hand held device for exercise and amusement has a clear plastic circular tube with a central handle. One or more balls are inserted into the circular tube. One holds the central handle and causes the ball(s) to move around the tube. Balls of different weight can be inserted in the tube. The device can be illuminated. The illumination may take the form of lights which are turned ON or OFF by the motion of the ball(s).

10 Claims, 2 Drawing Sheets

HAND HELD EXERCISE AND AMUSEMENT DEVICE

BACKGROUND OF THE INVENTION

1. Field of the Invention

This invention relates to a device for exercise and amusement, which has a clear plastic circular tube with a central handle. One or more balls are inserted into the circular tube. One holds the central handle and causes the ball(s) to move around the tube. Balls of different weight can be inserted in the tube. The device can be illuminated. The illumination may take the form of lights which are turned ON or OFF by the motion of the ball(s).

2. Description of the Prior Art

The following prior art U.S. patents disclose devices pertinent to the present invention.

Giraldi, U.S. Pat No. 1,623,869, shows a gripper with a pivoting circular grip with a central spring 15. The grip pivots against the spring in slot 8.

Neumann, U.S. Pat. No. 1,638,003, discloses a chest expander with a single strand rubber tube c and two balls, a and b, which serve as grips on the two ends of the tube.

Bidak, U.S. Pat. No. 2,475,656, exercises the wrists by winding up a weighted cord on a reel.

Phillips, U.S. Pat. No. 4,356,915, FIG. 2, shows a device for storing marbles. Two marbles 30 are inserted in a hollow circular tube 21. The tube has a central structure including spokes 24 and central hub 23.

Wallisch, U.S. Pat. No. 4,770,409, discloses a wrist exercise device with a central handle attached to an arcuate slide.

Brant, U.S. Pat. No. 5,058,885 teaches a weighted ball with a finger grip showing a baseball and a football.

Haber, et al., U.S. Pat. No. 5,399,133 disclose a hand grip 22 with adjustable resistance provided in a compound array of motions.

SUMMARY OF THE INVENTION

The present invention related to a hand held exercise and amusement device. The invention includes a clear plastic circular tube with a central handle. One or more balls are inserted into the circular tube. One holds the central handle and causes the ball(s) to move around the tube. Balls of different weight can be inserted in the tube. The device can be illuminated. The illumination may take the form of lights which are turned ON or OFF by the motion of the ball(s).

The lights are controlled by one or more switches. These switches may be of the type which are actuated by contact of a ball with an element of the switch. Such a contact may be electrical (where a metal ball completes the circuit causing the lamp to illuminate. Alternatively, the contact may be mechanical where a ball touching an element of a switch causes it to close and illuminate a light.

A battery compartment may provided to provide power to the lights and switches.

A principal object of this invention is the provision of an exercise and amusement device having a hollow central handle and a hollow circular tube.

Another object and advantage of this invention is the provision of a device of the class described where a hollow central handle permits balls to be inserted in the handle and to travel within the handle as well as within the circular tube.

A principal object and advantage of the present invention is the provision of an exercise device for the arm and the wrist. A still further object and advantage of the invention is the provision of an exercise device which uses one or more balls rotating in a circular tube. A still further object of the invention is the provision of an exercise device which uses balls of different weights and different materials to vary the mass of the device.

Another object and advantage of the invention is the provision of a device which is illuminated responsive to the movement of the balls in the tube.

A still further object and advantage of the invention is the provision of device where the balls may travel in and through a central hollow handle. Another object and advantage of the invention is the provision of an amusement device which incorporates one or more balls in a clear housing and permits the balls to move in all elements of the device.

BRIEF DESCRIPTION OF THE DRAWINGS

These as well as further objects and advantages of the invention will become apparent to those skilled in the art from a review of the following detailed specification of my invention reference being made to the accompanying drawings in which.

DESCRIPTION OF THE PREFERRED EMBODIMENTS

Figure 1:
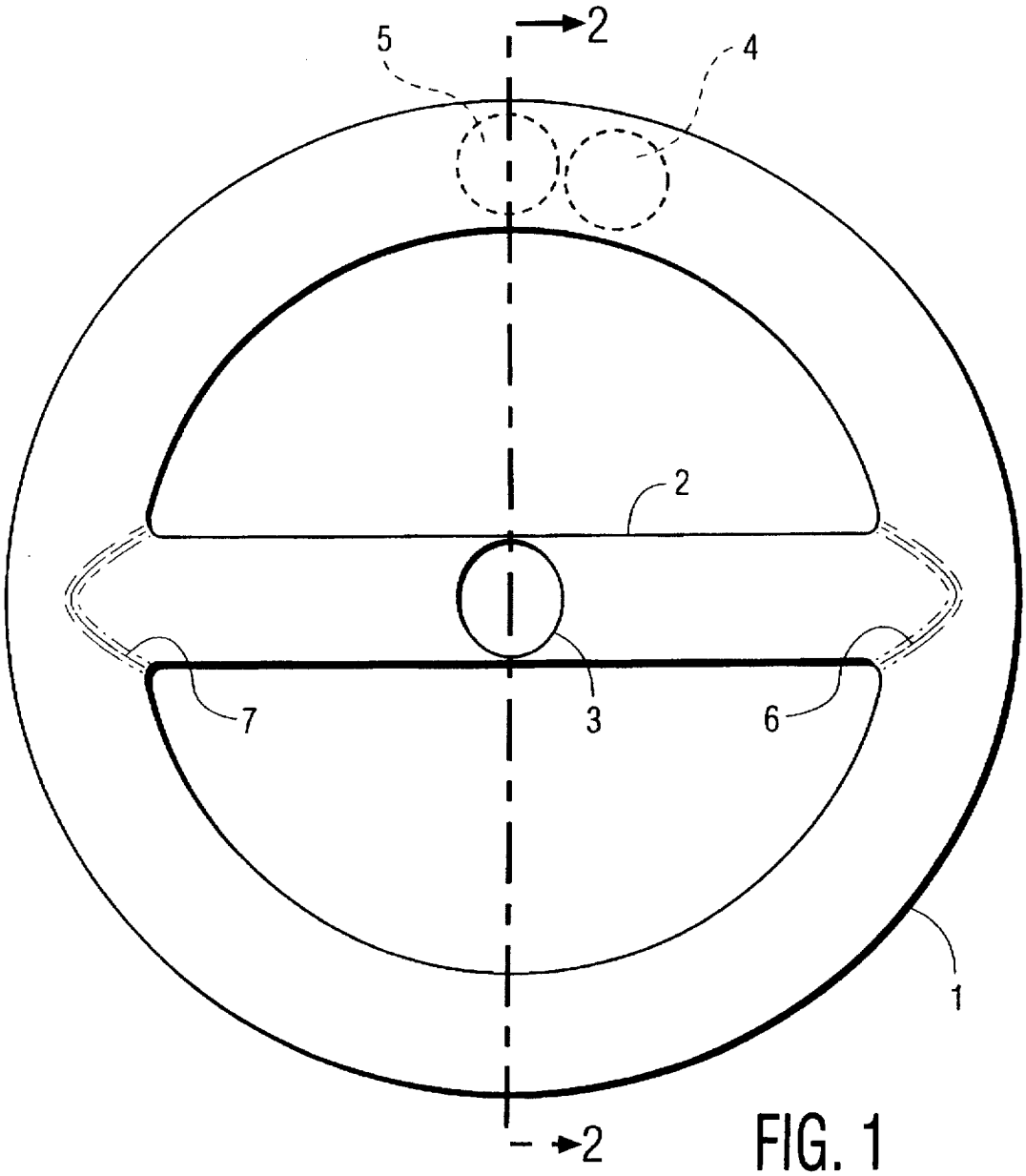
FIG. 1 is a plan view of the apparatus in accordance with my invention.
Figure 2:
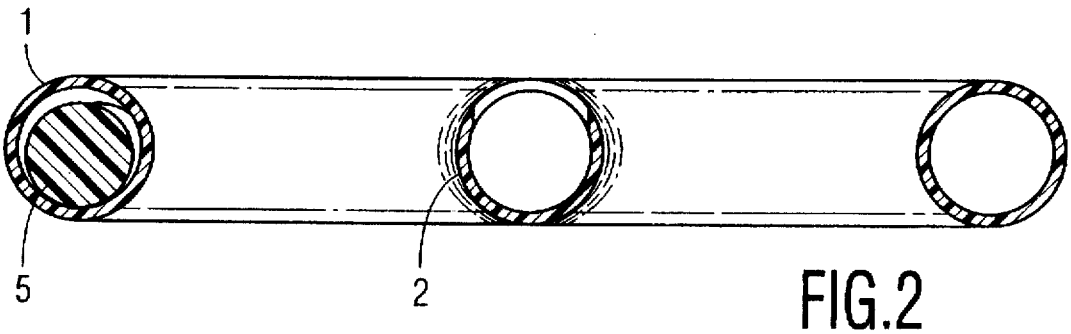
FIG. 2 is a sectional view of the apparatus shown in FIG. 1, taken along the line 2—2 of FIG. 1.

As shown in FIGS. 1–2, the invention includes a hollow circular tube 1 having a hollow central handle 2 mounted across the tube 1. The hollow central handle 2 has a hole 3 formed centrally of the handle. One or more balls, such as 4 and 5 are inserted in the apparatus by putting them in the hole 3 in the handle 2. The balls are free to travel within the hollow tube 1 and within the hollow handle 2. The tube 1 and handle 2 are formed of clear plastic. The handle is connected to the tube at 6 and 7.

As will now be seen, the present invention is used by placing one or more of the balls 4,5 in the hole 3. The device is grasped at the handle 2 by the hand of the user. The user may then rotate his or her wrist against the force of the balls on the walls of the tube. Compound motions of the device by the user can generated as desired.

The hole 3 may include a cover, not shown. In the embodiment shown in FIGS. 1–2, the user's hand covers the hole to prevent the balls from unintentionally separating from the device.

The balls 4,5 may be provided in different weights to change the amount of force required by a user to manipulate the invention and the exercise value of the device.

For amusement, the device may be illuminated with the illumination controlled by contact of the balls 4, 5 on the switches to turn ON lights as a function of the user's actions in moving the balls in the tube 1 and handle 2.

Figure 3:
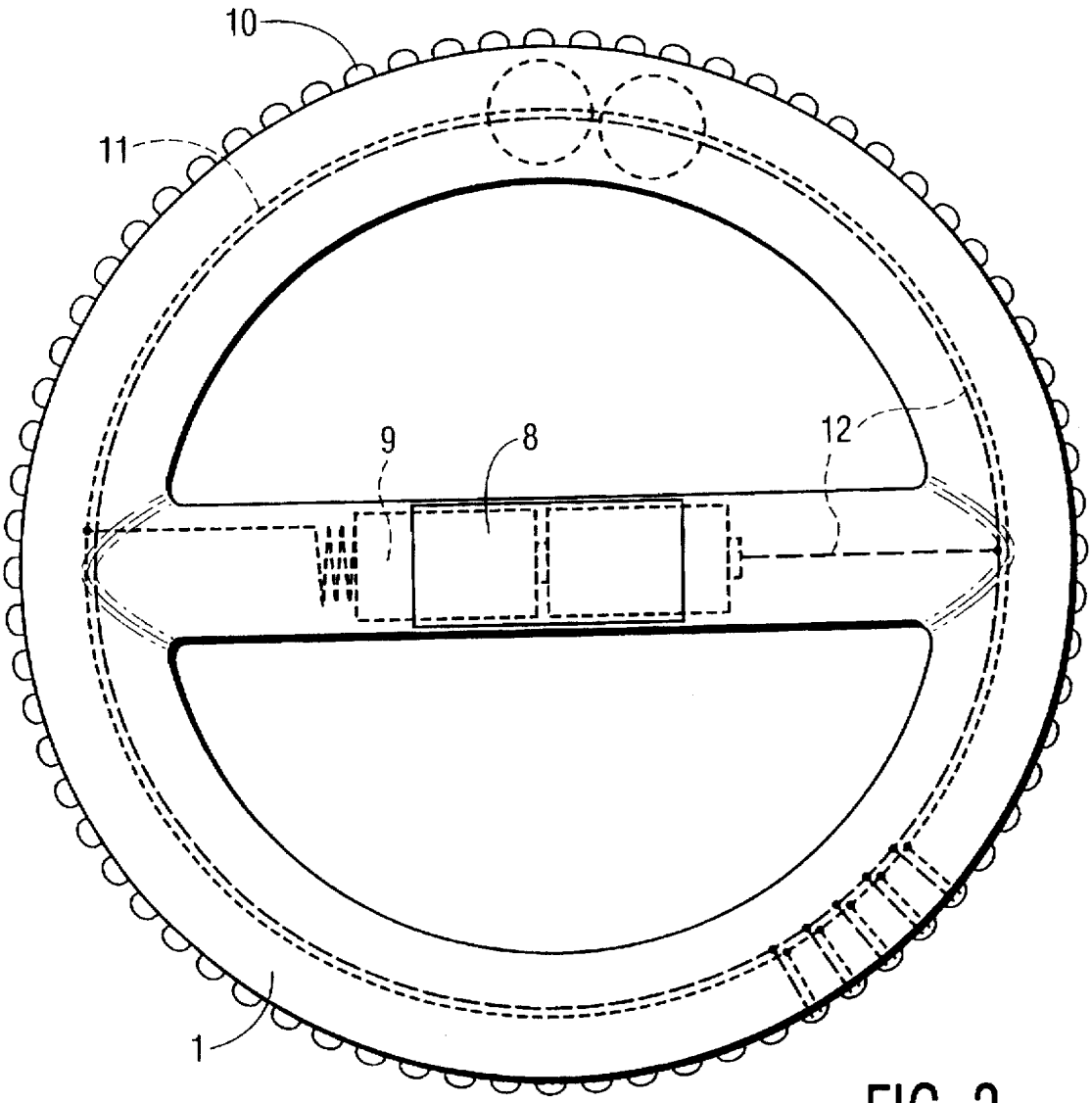
FIG. 3 is a plan view of an illuminated apparatus in accordance with my invention.

FIG. 3 shows a plurality of light bulbs or LED devices 10 mounted on tile periphery of circular tube 1. These devices 10 are powered by a battery 9 mounted in a portion of handle 2 beneath removable door 8. The lights 10 are wired in parallel across wires 11 and 12.

Figure 4:
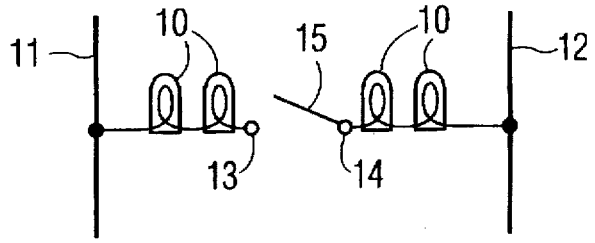
FIG. 4 is a schematic diagram of the connection of the lights of FIG. 3.

As shown in FIG. 4 a group of lights 10 is wired across wires 11 and 12. The parallel connection is completed when the circuit between contacts 13 and 14 is completed as when metallic ball such as 4 or 5 touches an impact switch 15.

As will now be apparent to those skilled in the art, the exercise and amusement apparatus of the present invention provides the user with wrist, hand, arm, shoulder and upper body motions against the resistance generated by one or more balls rotating in a hollow circular tube.

The device will set up a static charge widen plastic balls are used. This charge may be employed for further amusement as by using it to pick up or otherwise move papers.

It is also within the scope of the invention to strap the device onto different parts of the body such as the head, foot or knee for exercise. Alternatively, multiple circular tubes may be employed with or without connecting paths between tubes.

The device may be modified by inverting the entrance hole so that it faces downward. A net is placed beneath the hole with the object of the game being to cause the ball to move to and from the net to the hole.

Further modifications to the method and apparatus of the invention may be made without departing from the spirit and scope of the invention; accordingly, what is sought to be protected is set forth in the appended claims.

I claim:

1. An exercise and amusement device comprising: a hollow circular tube, a hollow handle connected across the diameter of said hollow circular tube, said handle having an aperture therein, and one or more balls for insertion in said aperture and, thereafter, into said handle and into said hollow circular tube.

2. The exercise and amusement device of claim 1 wherein said balls may be formed of materials of different weight.

3. The exercise and amusement device of claim 1 further including illumination means attached to said device for illuminating said device by contact from said balls.

4. The exercise and amusement device of claim 3 wherein said illumination means includes at least one electrical switch and at least one electrical light connected to said electrical switch.

5. The exercise and amusement device of claim 4 wherein said electrical switch includes an electrical circuit which is completed by contact of said ball.

6. The exercise and amusement device of claim 5 wherein said electrical switch includes control means for actuating said switch after contact by said ball.

7. The exercise and amusement device of claim 6 wherein said hollow circular tube is formed of clear material such that said ball is visible in said tube.

8. The exercise and amusement device of claim 7 wherein said hollow handle is formed of clear material such that said ball is visible in said handle.

9. An exercise and amusement device comprising: a hollow tube, a hollow handle connected to said hollow tube, said hollow handle having an aperture therein, and one or more balls for insertion in said aperture and, thereafter, into said hollow handle and into said hollow tube.

10. The exercise and amusement device of claim 9 further including illumination means connected to said hollow tube for illuminating said device by contact with said balls.

* * * * *